US008878751B2

(12) United States Patent
Chung et al.

(10) Patent No.: US 8,878,751 B2
(45) Date of Patent: Nov. 4, 2014

(54) ORGANIC LIGHT EMITTING DISPLAY DEVICE

(75) Inventors: Bo-Yong Chung, Yongin (KR); Yong-Sung Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 482 days.

(21) Appl. No.: 13/154,287

(22) Filed: Jun. 6, 2011

(65) Prior Publication Data

US 2012/0038612 A1 Feb. 16, 2012

(30) Foreign Application Priority Data

Aug. 10, 2010 (KR) ..... 10-2010-0076855

(51) Int. Cl.
*G09G 3/30* (2006.01)
*G09G 3/32* (2006.01)

(52) U.S. Cl.
CPC ..... *G09G 3/3233* (2013.01); *G09G 2300/0861* (2013.01); *G09G 2320/043* (2013.01); *G09G 2300/0852* (2013.01)
USPC ..... 345/76; 345/92

(58) Field of Classification Search
USPC ..... 345/36, 39, 44–46, 74.1–104; 315/169.3; 313/463
See application file for complete search history.

(56) References Cited

U.S. PATENT DOCUMENTS

| | | | | |
|---|---|---|---|---|
| 2007/0024541 | A1 | 2/2007 | Ryu et al. | |
| 2007/0273619 | A1 | 11/2007 | Kitazawa et al. | |
| 2007/0290954 | A1* | 12/2007 | Miyazawa | 345/76 |
| 2010/0033511 | A1 | 2/2010 | Yamashita et al. | |

FOREIGN PATENT DOCUMENTS

| | | | |
|---|---|---|---|
| CN | 1909038 | A | 2/2007 |
| CN | 101093641 | A | 12/2007 |
| CN | 101645235 | A | 2/2010 |
| KR | 10-2005-0106834 | A | 11/2005 |
| KR | 10-2006-0104841 | A | 10/2006 |
| KR | 10-2006-0112991 | A | 11/2006 |
| KR | 10-2008-0080754 | A | 9/2008 |

* cited by examiner

*Primary Examiner* — Kevin M Nguyen
*Assistant Examiner* — Cory Almeida
(74) *Attorney, Agent, or Firm* — Christie, Parker & Hale, LLP

(57) ABSTRACT

An organic light emitting display includes: pixels located at crossing regions between scan lines and data lines; a first control line and a second control line commonly coupled to the pixels; a control line driver configured to supply a first control signal to the first control line for a reset period and to supply a second control signal to the second control line during the reset period and a compensation period. Each pixel includes: an organic light emitting diode; a first transistor configured to control an amount of current supplied from a first power source coupled to a first electrode to a second power source via the organic light emitting diode; a second transistor configured to be turned on when the second control signal is supplied; and a fourth transistor configured to supply an initial voltage to a second electrode of the first transistor when the first control signal is supplied.

15 Claims, 8 Drawing Sheets

ORGANIC LIGHT EMITTING DISPLAY DEVICE

CROSS-REFERENCE TO RELATED APPLICATION

This application claims priority to and the benefit of Korean Patent Application No. 10-2010-0076855, filed on Aug. 10, 2010, in the Korean Intellectual Property Office, the entire content of which is incorporated herein by reference.

BACKGROUND

1. Field

The present invention relates to an organic light emitting display device, and more particularly, to an organic light emitting display which is driven in a concurrent (e.g., simultaneous) emission method.

2. Description of Related Art

In recent years, various flat panel displays that can overcome the disadvantages of cathode ray tubes, i.e., the heavy weight and large volume of the cathode ray tubes, have been developed. Such flat panel displays includes liquid crystal displays (LCDs), field emission displays (FEDs), plasma display panels (PDPs), and organic light emitting display devices.

An organic light emitting display device displays an image using organic light emitting diodes that generate light by recombining electrons and holes, and has a quick response and is driven with low power consumption.

The organic light emitting display device includes a plurality of data lines, scan lines, and power lines, and a plurality of pixels arranged in a matrix form at crossing regions of the data lines, the scan lines, and the power lines. Each pixel includes an organic light emitting diode, at least two transistors including a drive transistor, and at least one capacitor.

The organic light emitting display device is driven generally in a progressive emission method. In the progressive emission method, data are sequentially input in accordance with scan signals provided on the scan lines, and pixels are sequentially emitted in units of horizontal lines in an order that is the same as the input order of the data.

However, according to the progressive emission method, cross-talks are caused when a 3D image is realized. In order to overcome the disadvantages, a method of adding non-emitting periods between frames has been suggested but the light emitting time in this method is low.

SUMMARY

Accordingly, embodiments according to the present invention have been made to provide an organic light emitting display device which is driven in a concurrent (e.g., simultaneous) emission method.

Embodiments according to the present invention also provide an organic light emitting display device which is driven in a concurrent (e.g., simultaneous) light emitting method without power voltages (a first power source and a second power source) being changed.

In order to achieve the above aspects, there is provided an organic light emitting display device having a frame period including a reset period, a compensation period, a data period, and a light emission period, the organic light emitting display device including: pixels located at crossing regions between scan lines and data lines; a first control line and a second control line commonly coupled to the pixels; a control line driver configured to supply a first control signal to the first control line for the reset period and to supply a second control signal to the second control line during the reset period and the compensation period.

Each of the pixels includes: an organic light emitting diode; a first transistor having a first electrode, a second electrode and a gate electrode and configured to control an amount of current supplied from a first power source coupled to the first electrode to a second power source via the organic light emitting diode; a second transistor coupled between the gate electrode of the first transistor and the second electrode of the first transistor and configured to be turned on when the second control signal is supplied; and a fourth transistor coupled to the second electrode of the first transistor and configured to supply an initial voltage to the second electrode of the first transistor when the first control signal is supplied.

During the reset period, the compensation period, and the data period, the pixels may be set to a non-emitting state.

The organic light emitting display device may further include: a scan driver configured to concurrently supply a first scan signal to the scan lines during the reset period and the compensation period and to sequentially supply a second scan signal to the scan lines during the data period; and a data driver configured to supply data signals to the data lines in synchronization with the second scan signal during the data period.

The organic light emitting display device may further include: a light emission control line commonly coupled to the pixels.

The control line driver may be configured to supply a light emission control signal to the light emission control line during the reset period, the compensation period, and the data period.

Each of the pixels may include: a first capacitor coupled between the gate electrode of the first transistor and a second node; a third transistor coupled between the data line and the second node and configured to be turned on when a first scan signal and a second scan signal are supplied to the scan lines; a second capacitor coupled between the second node and the first power source; and a fifth transistor coupled to the second electrode of the first transistor and the organic light emitting diode and configured to be turned off when a light emission control signal is supplied to the light emission control line and to be turned on otherwise.

Each of the pixels may further include: a first capacitor coupled between the gate electrode of the first transistor and the data line; a third transistor coupled between the first capacitor and the data line and configured to be turned on when a first scan signal and a second scan signal are supplied to the scan lines; a second capacitor coupled between the gate electrode of the first transistor and the first power source; and a fifth transistor coupled between the second electrode of the first transistor and the organic light emitting diode and configured to be turned off when a light emission control signal is supplied to the light emission control line and to be turned on otherwise.

The data driver may be configured to supply a voltage of a reference power source to the data lines during the reset period, the compensation period, and the light emission period. And the voltage of the reference power source may be a voltage within a voltage range of the data signals.

The organic light emitting display device may further include: switching elements coupled between the data lines and the reference power source and configured to be turned on during the reset period, the compensation period, and the light emission period. And the voltage of the reference power source may be a voltage within a voltage range of the data signals.

The initial voltage may be a voltage lower than that of the first power source.

The fourth transistor may be configured to supply a voltage applied to an anode electrode of the organic light emitting diode as the initial voltage.

The fourth transistor may be configured to supply a voltage of the second power source as the initial voltage.

The fourth transistor may be electrically coupled to an initial power source for supplying the initial voltage.

According to embodiments of the present invention, an organic light emitting display device can be driven in a concurrent (e.g., simultaneous) emission method without changing a voltage of a power source. Furthermore, according to embodiments of the present invention, an image of a desired luminance can be displayed irrespective of voltage changes of the first power source and the second power source and a deviation of a threshold of the drive transistor.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
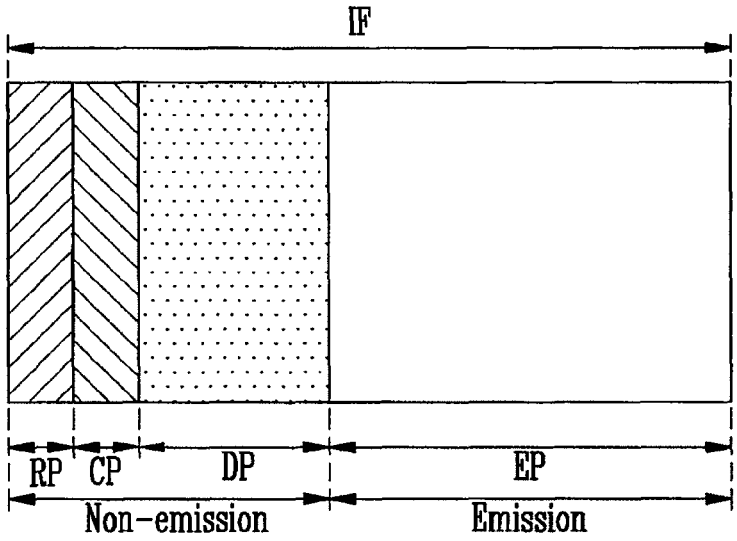
FIG. 1 is a view illustrating one frame period according to an embodiment of the present invention.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via a third embodiment. Further, some of the elements that are not essential to a complete understanding of the invention are omitted for clarity. Also, like reference numerals refer to like elements throughout.

Hereinafter, exemplary embodiments of the present invention will be described in detail with reference to FIGS. 1 to 12 so that those skilled in the art to which the invention pertains can easily carry out embodiments of the invention based on the information disclosed herein.

FIG. 1 is a view illustrating one frame period according to an embodiment of the present invention.

Referring to FIG. 1, one frame 1F according to an embodiment of the present invention is divided into a reset period RP, a compensation period CP, a data period DP, and an emission period EP.

In the reset period RP, an initial voltage is supplied to a gate electrode of a drive transistor included in each pixel. Here, the initial voltage refers to a voltage lower than a first power source ELVDD and is selected from various voltages applied to pixels.

In the compensation period CP, a threshold voltage of the drive transistor is compensated for in each pixel. During the compensation period CP, each pixel charges a voltage corresponding to a threshold voltage of the drive transistor.

In the data period DP, pixels are selected in units of horizontal lines (i.e., selected line by line), and data signals are supplied to the selected pixels. During the data period DP, each pixel charges a voltage corresponding to the data signal. Meanwhile, during the reset period RP, the compensation period CP, and the data period, the pixels are set to be in a non-emitting state.

During the emission period EP, the pixels produce light (e.g., light having a predetermined luminance). Here, during the compensation period, since the threshold voltage of the drive transistor is compensated for, an image of uniform luminance is displayed irrespective of a threshold voltage variation of the drive transistor during the emission period EP.

Figure 2:
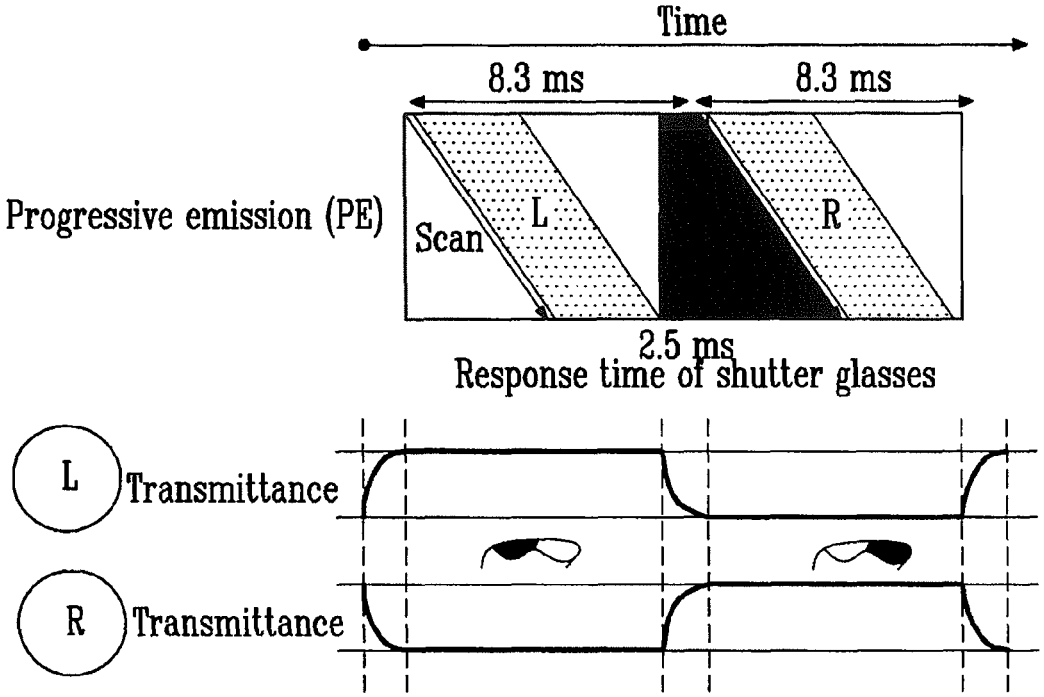
FIG. 2 is a view illustrating an example of realizing a shutter glasses type 3D display in a progressive emission method.

FIG. 2 is a view illustrating an example of realizing a shutter glasses type 3D display in a progressive emission method.

Referring to FIG. 2, when a screen is output in a progressive emission method, light emission needs to be stopped for a response time (e.g., 2.5 ms) of shutter glasses to reduce or prevent cross-talks between right and left eye images. That is, a non-emitting period is additionally created by the response time of the shutter glasses between a frame (i frame: i is a natural number) in which a left eye image is output and a frame (i+1 frame) in which a right eye is output, and accordingly duty ratio is reduced.

Figure 3:
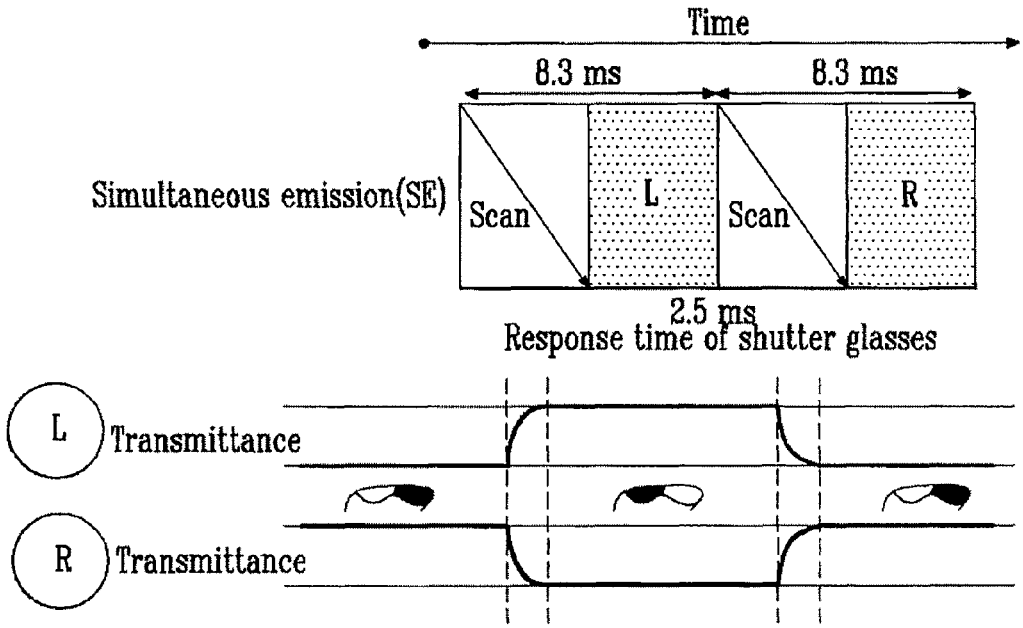
FIG. 3 is a view illustrating an example of realizing a shutter glasses type 3D display in a concurrent (e.g., simultaneous) emission method according to an embodiment of the present invention.

FIG. 3 is a view illustrating an example of realizing a shutter glasses type 3D display in a concurrent (e.g., simultaneous) emission method according to an embodiment of the present invention.

Referring to FIG. 3, when a screen is output in a concurrent (e.g., simultaneous) emission method, light is concurrently (e.g., simultaneously) emitted by all of the pixels and the pixels are set to be in a non-emitting state in a period other than the emission period EP. Thus, a non-emitting period is naturally secured between a period in which a left eye image is output and a period in which a right eye image is output.

That is, the reset period RP, the compensation period CP, and the data period DP are set to a non-emitting state between the i frame and the (i+1) frame, and when the period is synchronized with the response time of the shutter glasses, duty ratio does not need to be reduced, which is different from the progressive emission method.

Figure 4:
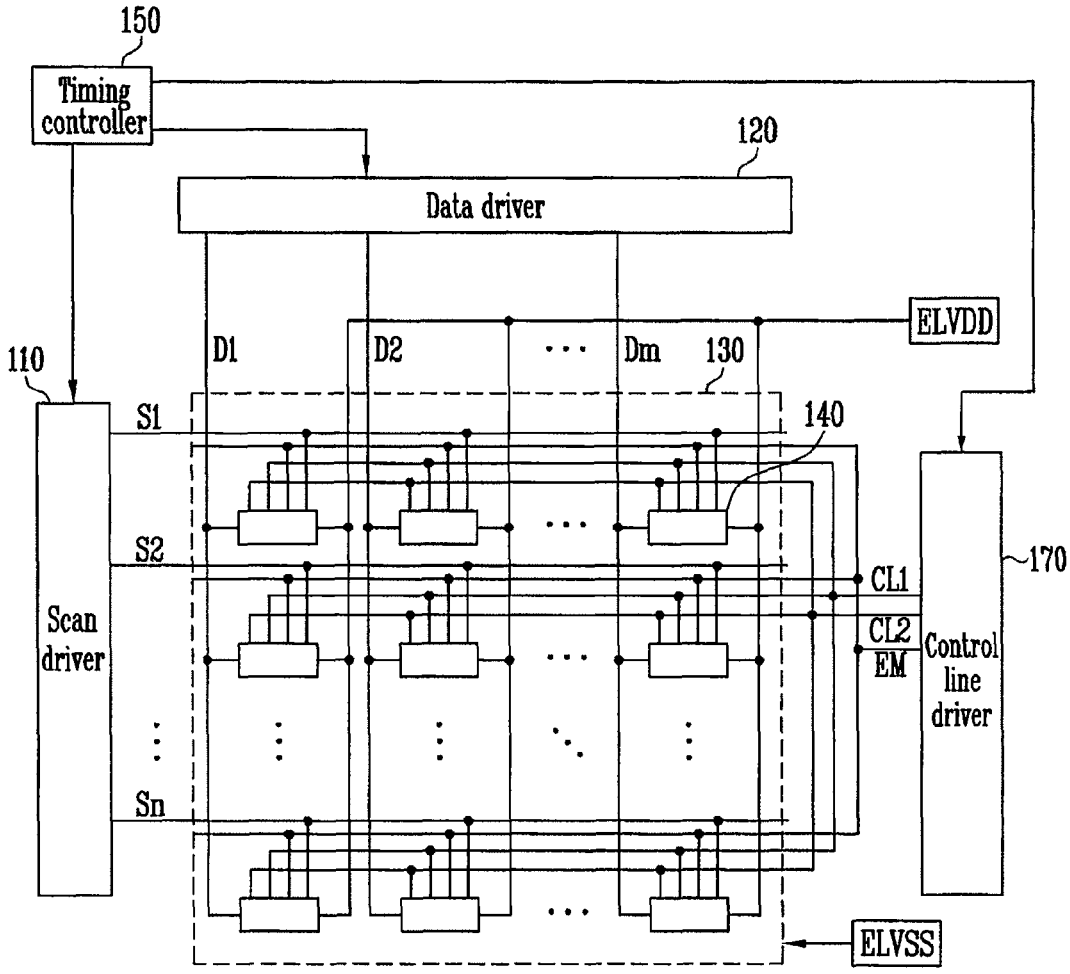
FIG. 4 is a view illustrating an organic light emitting display device according to an embodiment of the present invention.

FIG. 4 is a view illustrating an organic light emitting display device according to an embodiment of the present invention.

Referring to FIG. 4, the organic light emitting display device according to one embodiment of the present invention includes a display unit 130 including pixels 140 connected to scan lines S1 to Sn and data lines D1 to Dm, a scan drive unit (or scan driver) 110 for driving the scan lines S1 to Sn, a data drive unit (or data driver) 120 for driving the data lines D1 to Dm, a control line drive unit (or control line driver) 170 for driving a light emission control line EM, a first control line CL1, and a second control line CL2, a timing control unit (or timing controller) 150 for controlling the scan drive unit 110, the data drive unit 120, and the control line drive unit 170.

The scan drive unit 110 concurrently (e.g., simultaneously) supplies a scan signal (or a first scan signal) to the scan lines S1 to Sn during the reset period RP and the compensation period CP. The scan drive unit 110 sequentially supplies a scan signal (or a second scan signal) to the scan lines S1 to Sn during the data period DP.

The data drive unit 120 supplies a voltage of a reference power source Vref to the data lines D1 to Dm during the reset period, the compensation period CP, and the emission period EP, and supplies data signals to the data lines D1 to Dm such that the data signals are synchronized with scan signals during the data period DP. Here, the voltage of the reference power source Vref is set to a voltage within a certain range of the data signals.

The control line drive unit 170 supplies a first control signal to a first control line CL1 during the reset period, and supplies a second control signal to a second control line CL2 during the reset period and the compensation period. The control line drive unit 170 supplies an emission control signal to an emission control line EM during the reset period RP, the compensation period CP, and the data period DP. The emission control line EM is commonly connected to the pixels 140, and the pixels 140 are set to a non-emitting state during the reset period RP, the compensation period CP, and the data period DP when an emission control signal is supplied.

The timing control unit 150 controls the scan drive unit 110, the data drive unit 120, and the control line drive unit 170 in response to the synchronization signals supplied from the outside.

The display unit 130 receives a first power source ELVDD and a second power source ELVSS from the outside and supplies them to the pixels 140. Each of the pixels 140 charges a voltage corresponding to a threshold voltage of the respective drive transistor in the pixel during the compensation period CP, and charges a voltage corresponding to a respective data signal during the data period DP. During the emission period EP, the pixels 140 produce light corresponding to respective voltages charged corresponding to the respective data signals.

Figure 5:
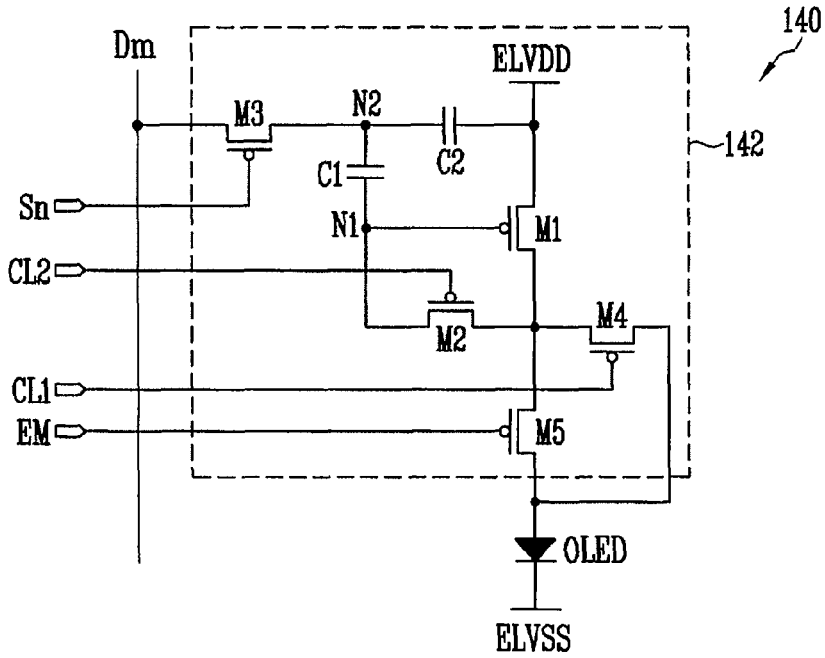
FIG. 5 is a view illustrating the first embodiment of a pixel of FIG. 4.

FIG. 5 is a view illustrating a pixel according to a first embodiment of the present invention. In FIG. 5, a pixel connected to a n-th scan line Sn and a m-th data line Dm is illustrated for the convenience of description.

Referring to FIG. 5, the pixel 140 according to the first embodiment of the present invention includes an organic light emitting diode OLED, and a pixel circuit 142 for controlling the amount of current supplied to the organic light emitting diode OLED.

An anode electrode of the organic light emitting diode OLED is connected to the pixel circuit 142 and a cathode electrode of the organic light emitting diode OLED is connected to the second power source ELVSS. The organic light emitting diode OLED produces light (e.g., light having a predetermined luminance) in response to a current supplied from the pixel circuit 142.

The pixel circuit 142 includes first to fifth transistors M1 to M5 and first and second capacitors C1 and C2.

A gate electrode of the first transistor M1 is connected to a first node N1, and the first electrode is connected to the first power source ELVDD. A second electrode of the first transistor M1 is connected to a first electrode of the fifth transistor M5. The first transistor M1 controls the amount of current supplied from the first power source ELVDD to the second power source ELVSS via the organic light emitting diode OLED in response to (or in accordance with) a voltage applied to the first node N1.

A first electrode of the second transistor M2 is connected to the first transistor M1, and a second electrode of the second transistor M2 is connected to the first node N1. A gate electrode of the second transistor M2 is connected to the second control line CL2. The second transistor M2 is turned on when a second control signal is supplied to the second control line CL2 to electrically connect the gate electrode of the first transistor M1 and the second electrode of the first transistor M1. In this case, the first transistor M1 is connected in the form of a diode. In other words, the first transistor M1 is diode-connected.

A first electrode of the third transistor M3 is connected to a data line Dm and a second electrode of the third transistor M3 is connected to a second node N2. A gate electrode of the third transistor M3 is connected to the scan line Sn. The third transistor M3 is turned on when a scan signal is supplied to the scan line Sn to electrically connect the data line Dm and the second node N2.

A first electrode of the fourth transistor M4 is connected to a second electrode of the first transistor M1, and a second electrode of the fourth transistor M4 is connected to an anode electrode of the organic light emitting diode OLED. A gate electrode of the fourth transistor M4 is connected to the first control line CL1. The fourth transistor M4 is turned on when a first control signal is supplied to the first control line CL1 to connect a second electrode of the first transistor M1 and an anode electrode of the organic light emitting diode OLED.

A first electrode of the fifth transistor M5 is connected to the second electrode of the first transistor M2, and a second electrode of the fifth transistor M5 is connected to the anode electrode of the organic light emitting diode OLED. A gate electrode of the fifth transistor M5 is connected to the emission control line EM. The fifth transistor M5 is turned off when an emission control signal is supplied to the emission control line EM, and is turned on when an emission control signal is not supplied.

The first capacitor C1 is connected between the first node N1 and the second node N2. The first capacitor C1 charges a voltage corresponding to a threshold voltage of the first transistor M1.

The second capacitor C2 is connected between the second node N2 and the first power source ELVDD. The second capacitor C2 charges a voltage corresponding to a data signal.

Figure 6:
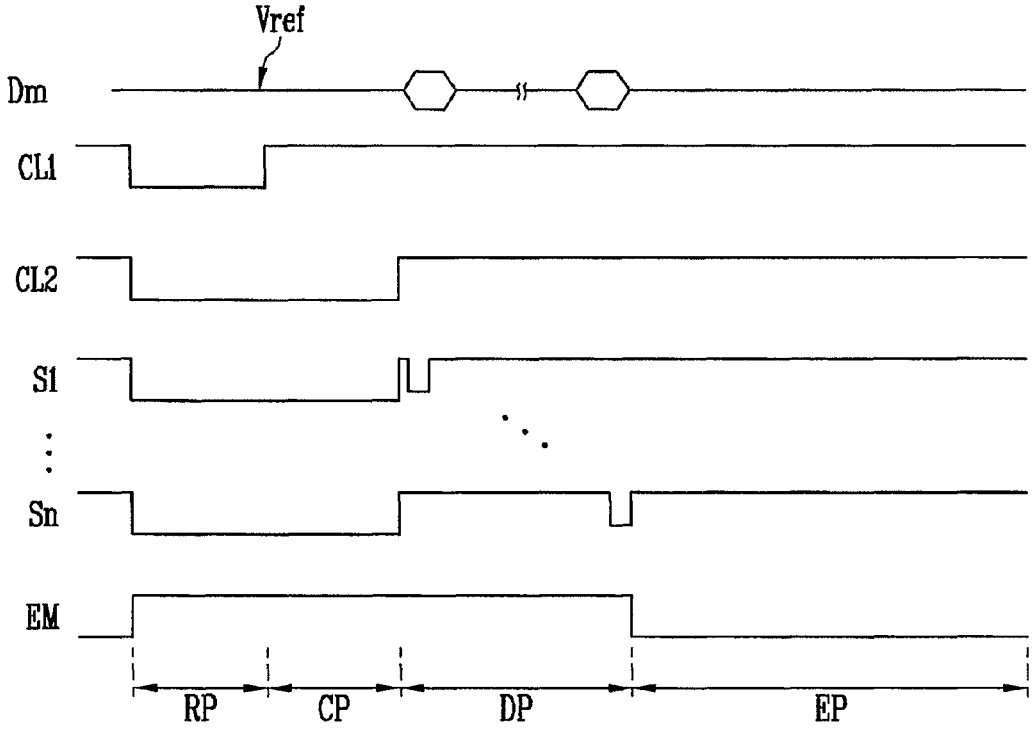
FIG. 6 is a waveform view illustrating a driving method for the pixel of FIG. 5.

FIG. 6 is a waveform view illustrating a driving method for the pixel of FIG. 5.

Referring to FIG. 6, a scan signal is supplied to the scan lines S1 to Sn during the reset period RP and the compensation period CP first, and an emission control signal is supplied to the emission control line EM during the reset period RP, the compensation period CP, and the data period DP. A reference voltage Vref is supplied to the data lines D1 to Dm during the reset period RP, the compensation period CP, and the emission period EP. A first control signal is supplied to the first control line CL1 during the reset period RP, and a second control signal is supplied to the second control line CL2 during the reset period RP and the compensation period CP.

When an emission control signal is supplied to the emission control line EM, the fifth transistor M5 is turned off.

When the fifth transistor M5 is turned off, the electrical connection between the organic light emitting diode OLED and the first transistor M1 is interrupted. Thus, the pixels 140 are set to a non-emitting state during the reset period RP, the compensation period CP, and the data period DP.

When a scan signal is supplied to the scan lines S1 to Sn, the third transistors M3 included in the pixels 140 are turned on. Then, a voltage of the reference power source Vref is supplied to the second nodes N2 of the pixels 140.

When a second control signal is supplied to the second control line CL2, the second transistor M2 is turned on. When the second transistor M2 is turned on, the gate electrode of the first transistor M1 is electrically connected to the second electrode of the first transistor M1, thereby diode-connecting the first transistor M1.

When a first control signal is supplied to the first control line CL1, the fourth transistor M4 is turned on. When the fourth transistor M4 is turned on, the anode electrode of the organic light emitting diode OLED is electrically connected to the second electrode of the first transistor M1. Then, a voltage (i.e., an initial voltage) applied to the anode electrode of the organic light emitting diode OLED is supplied to the first node N1.

Thereafter, supply of the first control signal to the first control line CL1 is stopped during the compensation period CP. The second transistor M2 remains turned on during the compensation period, and accordingly the first transistor M1 maintains connection in the form of a diode. In other words, the first transistor M1 remains diode-connected. Then, as the first node N1 is initialized to an initial voltage during the reset period RP, the first transistor M1 is turned on and accordingly the first node N1 is set to a voltage obtained by subtracting a threshold voltage of the first transistor M1 from the first power source ELVDD.

The first capacitor C1 charges a voltage corresponding to a difference between the second node N2 and the first node N1 during the compensation period. That is, the first capacitor C1 charges a voltage corresponding to a threshold voltage of the first transistor M1 during the compensation period.

A scan signal is sequentially supplied to the scan lines S1 to Sn during the data period DP, and data signals are supplied to the data lines D1 to Dm in synchronization with the scan signal. When the scan signal is supplied to the scan line Sn, the third transistor M3 is turned on. When the third transistor M3 is turned on, a data signal from the data line Dm is supplied to the second node N2.

Then, the second capacitor C2 charges a voltage corresponding to a data signal. Meanwhile, as the first node N1 is set to a floating state during the data period DP, the first capacitor C1 maintains a voltage charged in the previous period.

Hereinafter, a voltage change of the first node N1 will be described in detail. The second node N2 is set to a reference voltage Vref, and the first node N1 is set to a voltage obtained by subtracting the threshold voltage of the first transistor M1 from the first power source ELVDD. Thereafter, the voltage of the second node is changed from the reference voltage Vref to the voltage of the data signal, and the first node N2 is also changed in response to the voltage change of the second node N2.

Here, when a black color (e.g., a gray level corresponding to black) is to be expressed in a pixel 140, the data signal is set to a voltage higher than the reference voltage Vref, and accordingly the voltage of the first node N2 rises. Then, the first transistor M1 is turned on to realize a black color. When a white color (e.g., a gray level corresponding to white) is to be expressed in a pixel 140, the data signal is set to a voltage lower than the reference voltage Vref, and accordingly the voltage of the first node N2 also drops. Then, the amount of current supplied from the first transistor M1 to the organic light emitting diode OLED is controlled in response to (e.g., in accordance with) the voltage of a white color applied to the first node N1. That is, embodiments according to the present invention realize a certain gray level using the voltage difference between the reference voltage Vref and the data signal. In this case, the image of a desired luminance can be advantageously displayed irrespective of a voltage drop of the first power source ELVDD.

Supply of an emission control signal to the emission control line EM is stopped during the emission period EP. When the supply of the emission control signal to the emission control line EM is stopped, the fifth transistor M5 is turned on. When the fifth transistor M5 is turned on, the first transistor M1 is electrically connected to the organic light emitting diode OLED. Then, the first transistor M1 controls the amount of current supplied to the organic light emitting diode OLED in response to (e.g., in accordance with) a voltage applied to the first node N1 to generate light of a certain luminance.

Figure 7:
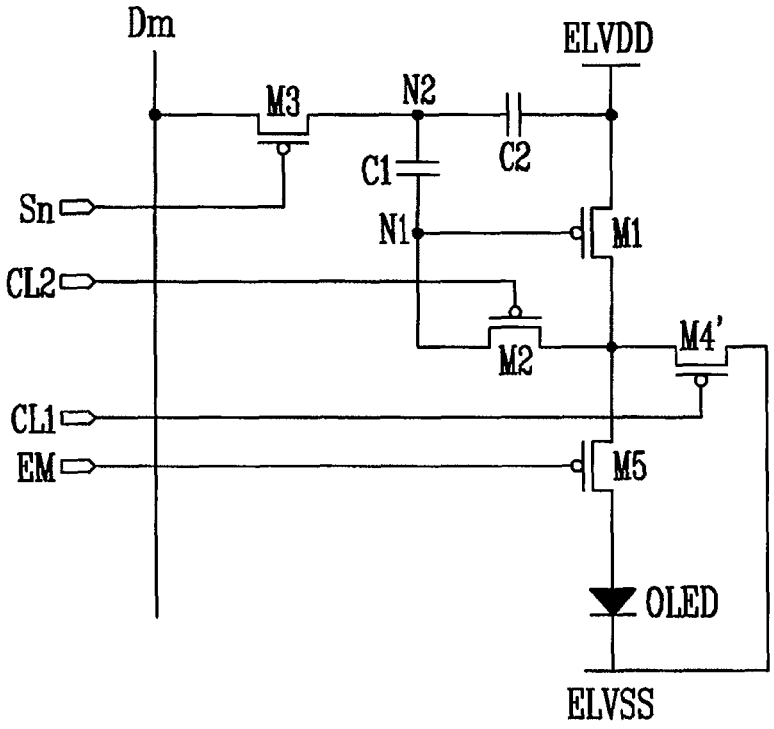
FIG. 7 is a view illustrating the second embodiment of a pixel of FIG. 4.

FIG. 7 is a view illustrating a pixel according to a second embodiment of the present invention. In the description of FIG. 7, the same elements as in FIG. 5 are referenced with the same reference numerals, and the details thereof will be omitted.

Referring to FIG. 7, the first electrode of the fourth transistor M4' is connected to a second electrode of the first transistor M1, and the second electrode of the fourth transistor M4' is connected to the second power source ELVSS. The gate electrode of the fourth transistor M4' is connected to the first control line CL1. The fourth transistor M4' is turned on when a first control signal is supplied to the first control line CL1 to supply a voltage of the second power source ELVSS to the second electrode of the first transistor M1. That is, in the second embodiment of the present invention, a second power source ELVSS is supplied as an initial voltage (e.g., an initialization voltage) for initializing the gate electrode of the first transistor M1. As other configurations and operations are substantially the same as in the pixel of FIG. 5, the details thereof will be omitted.

Figure 8:
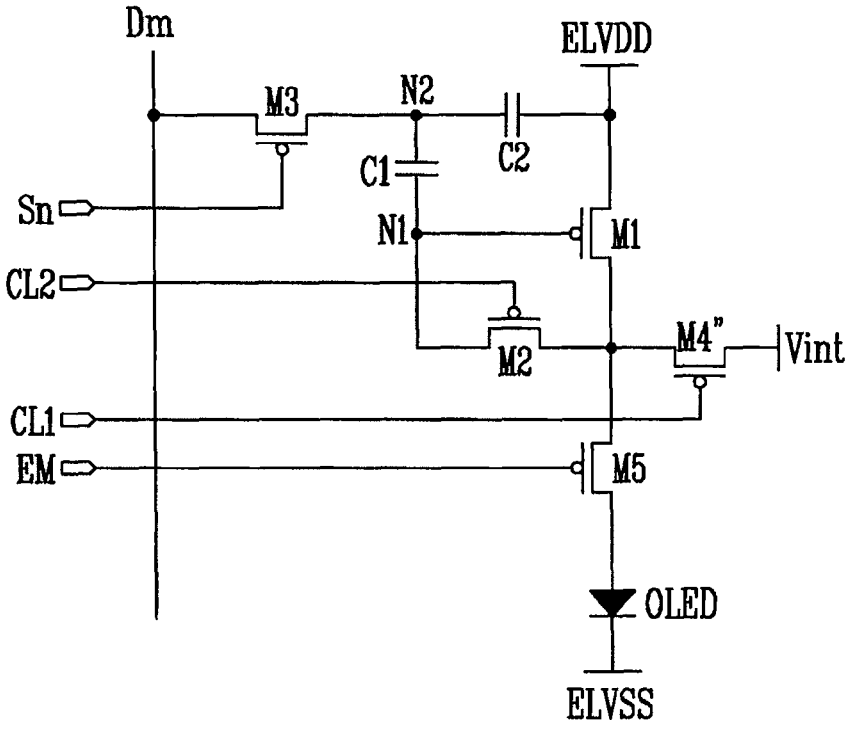
FIG. 8 is a view illustrating the third embodiment of a pixel of FIG. 4.

FIG. 8 is a view illustrating a pixel according to a third embodiment of the present invention. In the description of FIG. 8, the same elements as in FIG. 5 are referenced with the same reference numerals, and the details thereof will be omitted.

Referring to FIG. 8, the first electrode of the fourth transistor M4" is connected to a second electrode of the first transistor M1, and the second electrode of the fourth transistor M4" is connected to an initial power source Vint. The gate electrode of the fourth transistor M4" is connected to the first control line CL1. The fourth transistor M4" is turned on when a first control signal is supplied to the first control line CL1 to supply a voltage of the initial power source Vint to the second electrode of the first transistor M1. Here, the initial power source Vint is set to have a voltage lower than the first power source ELVDD. That is, in the third embodiment of the present invention, a separate initial voltage Vint is added to initialize the gate electrode of the first transistor M1. As other configurations and operations are substantially the same as in the pixel of FIG. 5, the details thereof will be omitted.

Figure 9:
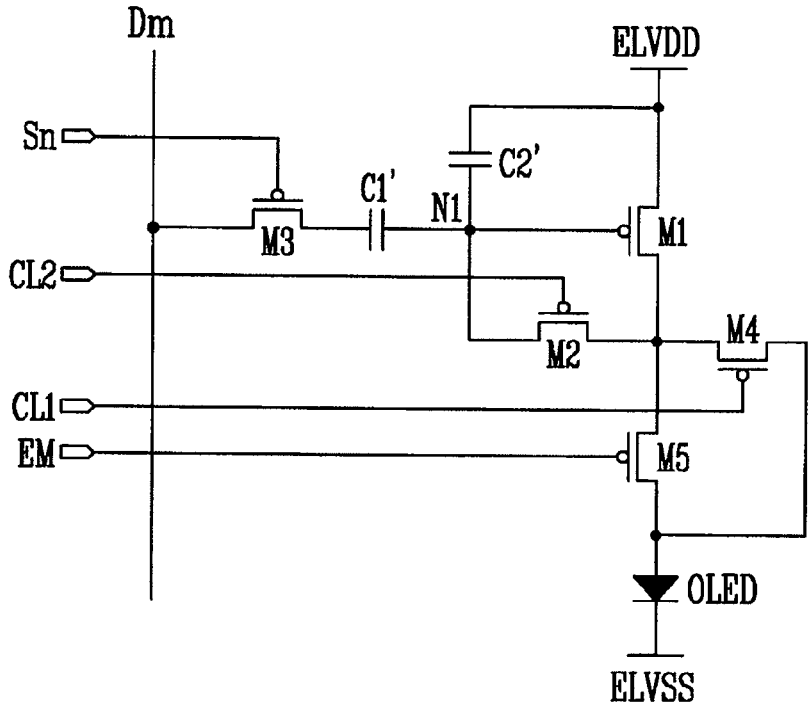
FIG. 9 is a view illustrating the fourth embodiment of a pixel of FIG. 4.

FIG. 9 is a view illustrating a pixel according to a fourth embodiment of the present invention. In the description of FIG. 9, the same elements as in FIG. 5 are referenced with the same reference numerals, and the details thereof will be omitted.

Referring to FIG. 9, the first capacitor C1' is connected to the first node N1 and the second electrode of the third transistor M3, and the second capacitor C2' is connected between the first node N1 and the first power source ELVDD. The first capacitor C1' charges a voltage corresponding to the threshold voltage of the first transistor M1, and the second capacitor C2' charges a voltage corresponding to a data signal.

Hereinafter, the operation of one embodiment according to the present invention will be described in association with FIG. 6 and FIG. 9. The fourth transistor M4 is turned on when a first control signal is supplied to the first control line CL1 during the reset period, and the second transistor M2 is turned on when a second control signal is supplied to the second control line CL2. When the fourth transistor M4 and the second transistor M2 are turned on, a voltage (i.e., an initial voltage) applied to the anode electrode of the organic light emitting diode OLED is supplied to the first node N1.

A second control signal is supplied to the second control line CL2 during the compensation period such that the second transistor M2 remains turned on. When the second transistor M2 is turned on, the first transistor M1 is connected in the form of a diode (i.e., diode-connected), and accordingly a voltage obtained by subtracting a threshold voltage of the first transistor M1 from the first power source ELVDD is applied to the first node N1.

A reference voltage Vref is applied to the second electrode of the third transistor M3 during the compensation period CP. In this case, the first capacitor C1' charges a reference voltage and a voltage corresponding to a voltage applied to the first node N1, i.e. a voltage corresponding to the threshold voltage of the first transistor M1 during the compensation period CP.

A scan signal is sequentially supplied to the scan lines S1 to Sn during the data period DP, and data signals are supplied to the data lines D1 to Dm in synchronization with the scan signal. When a scan signal is supplied to the scan line Sn, the third transistor M3 is turned on, and a voltage of the data signal is supplied to the first electrode of the first capacitor C1'. Then, the voltage of the first electrode of the first capacitor C1' is changed from the reference voltage Vref to the voltage of the data signal, and the voltage of the second electrode of the first capacitor C1', i.e., the voltage of the first node N1 is changed in response to it. Then, the second capacitor C2' charges a voltage corresponding to the difference between the first node N1 and the first power source ELVDD, i.e., a voltage corresponding to the data signal.

Supply of an emission control signal to the emission control line EM is stopped during the emission period EP, and accordingly the fifth transistor M5 is turned on. Then, the first transistor M1 controls the amount of current supplied to the organic light emitting diode OLED in response to (e.g., in accordance with) a voltage applied to the first node N1.

Figure 10:
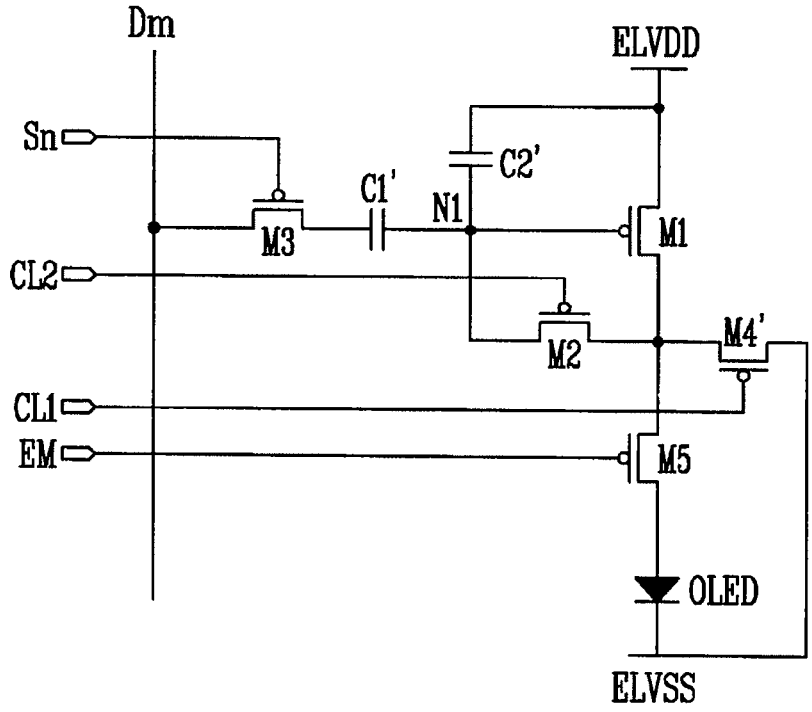
FIG. 10 is a view illustrating the fifth embodiment of a pixel of FIG. 4.

FIG. 10 is a view illustrating a pixel according to the fifth embodiment of the present invention. In the description of FIG. 10, the same elements as in FIG. 9 are referenced with the same reference numerals, and the details thereof will be omitted.

Referring to FIG. 10, the first electrode of the fourth transistor M4' is connected to the second electrode of the first transistor and the second electrode of the fourth transistor M4' is connected to the second power source ELVSS. The gate electrode of the fourth transistor M4' is connected to the first control line CL1. The fourth transistor M4' is turned on when a first control signal is supplied to the first control line CL1 to supply a voltage of the second power source ELVSS to the second electrode of the first transistor M1. That is, in the fifth embodiment of the present invention, a second power source ELVSS is supplied as an initial voltage for initializing the gate electrode of the first transistor M1. As other configurations and operations are substantially the same as in the pixel of FIG. 5, the details thereof will be omitted.

Figure 11:
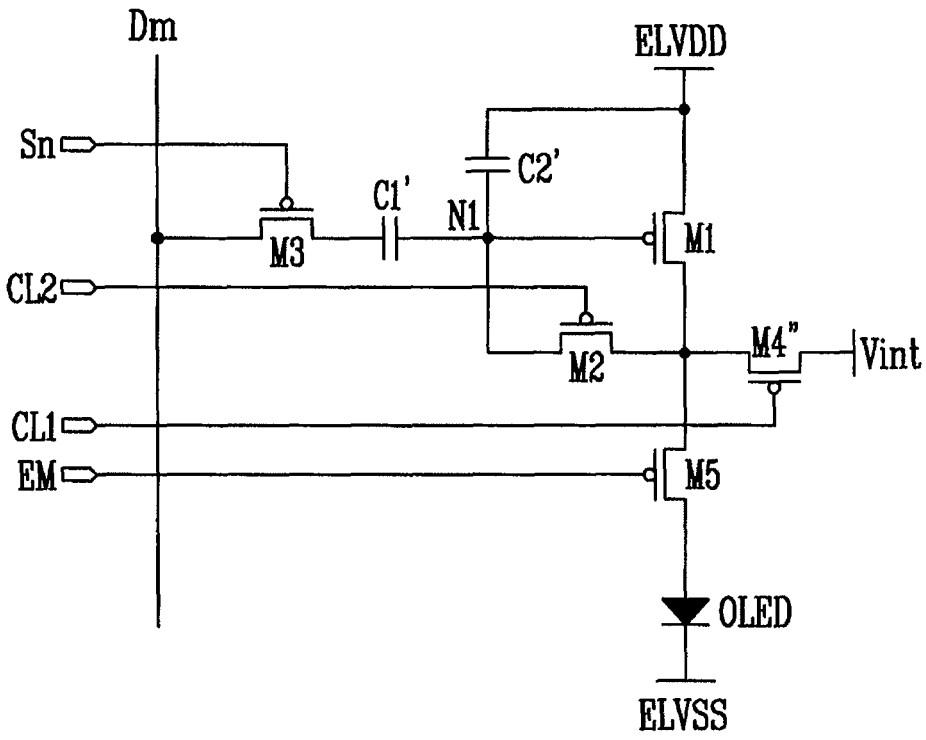
FIG. 11 is a view illustrating the sixth embodiment of a pixel of FIG. 4.

FIG. 11 is a view illustrating a pixel according to a fifth embodiment of the present invention. In the description of FIG. 11, the same elements as in FIG. 9 are referenced with the same reference numerals, and the details thereof will be omitted.

Referring to FIG. 11, the first electrode of the fourth transistor M4' is connected to a second electrode of the first transistor M1, and the second electrode of the fourth transistor M4' is connected to an initial power source Vint. The gate electrode of the fourth transistor M4' is connected to the first control line CL1. The fourth transistor M4' is turned on when a first control signal is supplied to the first control line CL1 to supply a voltage of the initial power source Vint to the second electrode of the first transistor M1. Here, the initial power source Vint is set to a voltage lower than the first power source ELVDD. That is, in the third embodiment of the present invention, a separate initial voltage Vint is added to initialize the gate electrode of the first transistor M1. As other configurations and operations are substantially the same as in the pixel of FIG. 5, the details thereof will be omitted.

Figure 12:
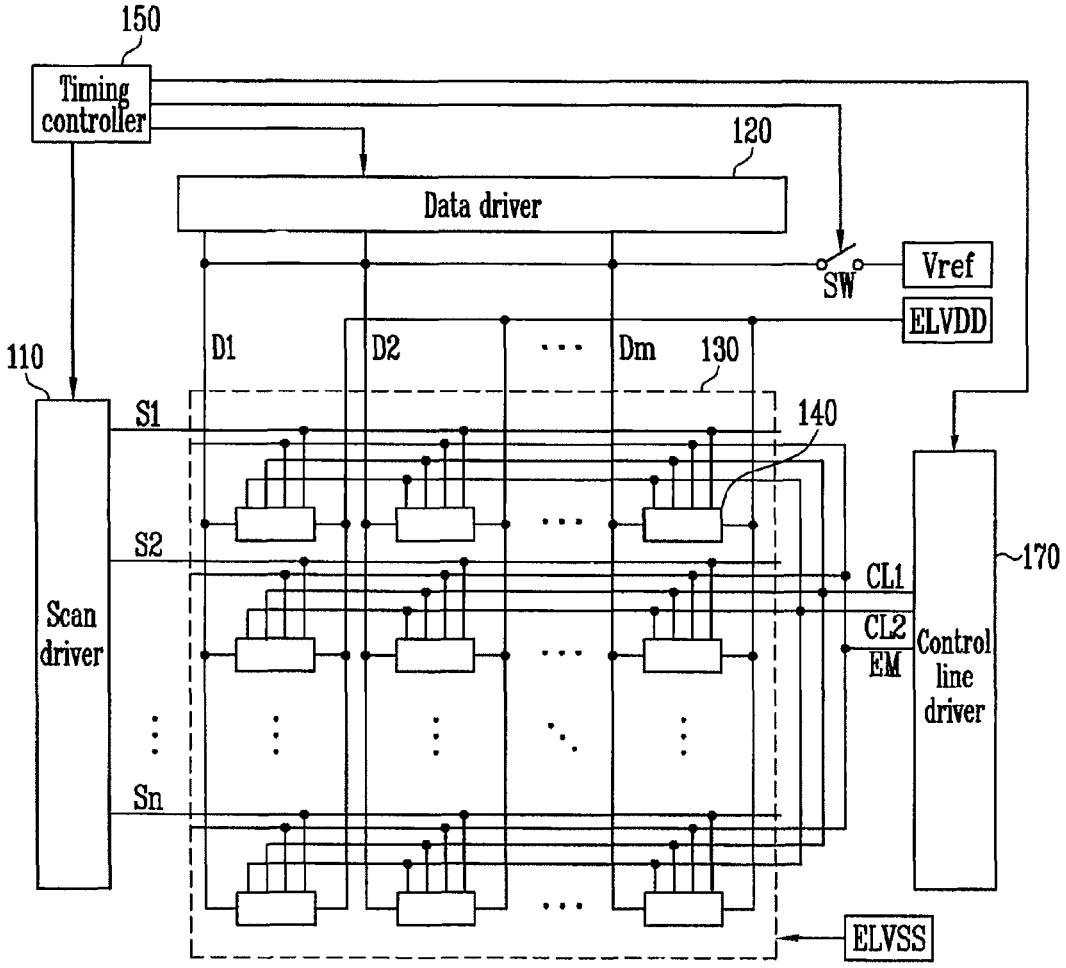
FIG. 12 is a view illustrating an organic light emitting display device according to another embodiment of the present invention.

FIG. 12 is a view illustrating an organic light emitting display device according to an embodiment of the present invention. In the description of FIG. 12, the same elements as in FIG. 4 are endowed with the same reference numerals, and the details thereof will be omitted.

Referring to FIG. 12, the organic light emitting display device according to the present embodiment of the present invention includes a switching device SW connected to the data lines D1 to Dm and the reference power source Vref. The switching device SW is turned on in response to control of the timing control unit 150 during the reset period RP, the compensation period CP, and the emission period EP. Then, the reference voltage Vref is supplied to the data lines D1 to Dm during the reset period RP, the compensation period CP, and the emission period EP.

If it is compared with the organic light emitting display device of FIG. 4, a voltage of a reset power source Vref is supplied to the data lines D1 to Dm in the data drive unit 120 during the reset period RP, the compensation period CP, and the emission period EP in FIG. 4. However, in the present embodiment of the present invention, a voltage of a reset power source Vref is supplied to the data lines D1 to Dm by adding a separate switching device SW to the outside of the data drive unit 120. Accordingly, when a separate switching device SW is added, the structure of the data drive unit 120 is not changed, making it possible to reduce manufacturing costs and set the voltage of the reference power source Vref more freely.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device having a frame period comprising a reset period, a compensation period, a data period, and a light emission period, the organic light emitting display device comprising:

pixels located at crossing regions between scan lines and data lines;

a first control line and a second control line commonly coupled to the pixels;

a control line driver configured to supply a first control signal to the first control line for the reset period and to supply a second control signal to the second control line during the reset period and the compensation period, wherein each of the pixels comprises:

an organic light emitting diode;

a first transistor having a first electrode, a second electrode and a gate electrode, and configured to control an amount of current supplied from a first power source through the first transistor from the first electrode to the second electrode, to a second power source via the organic light emitting diode;

a second transistor coupled between the gate electrode of the first transistor and the second electrode of the first transistor and configured to be turned on when the second control signal is supplied to diode-couple the first transistor; and a fourth transistor coupled to the second electrode of the first transistor and configured to supply an initial voltage to the second electrode of the first transistor when the first control signal is supplied, wherein the pixels are concurrently emitted during the light emission period.

2. The organic light emitting display device as claimed in claim 1, wherein during the reset period, the compensation period, and the data period, the pixels are set to a non-emitting state.

3. The organic light emitting display device as claimed in claim 1, further comprising:

a scan driver configured to concurrently supply a first scan signal to the scan lines during the reset period and the compensation period and to sequentially supply a second scan signal to the scan lines during the data period; and a data driver configured to supply data signals to the data lines in synchronization with the second scan signal during the data period.

4. The organic light emitting display device as claimed in claim 3, further comprising:

a light emission control line commonly coupled to the pixels.

5. The organic light emitting display device as claimed in claim 4, wherein the control line driver is configured to supply a light emission control signal to the light emission control line during the reset period, the compensation period, and the data period.

6. The organic light emitting display device as claimed in claim 5, wherein each of the pixels comprises:

a first capacitor coupled between the gate electrode of the first transistor and a second node;

a third transistor coupled between one of the data lines and the second node and configured to be turned on when the first scan signal and the second scan signal are supplied to the scan lines;

a second capacitor coupled between the second node and the first power source; and a fifth transistor coupled to the second electrode of the first transistor and the organic light emitting diode and configured to be turned off when the light emission control signal is supplied to the light emission control line and to be turned on otherwise.

7. The organic light emitting display device as claimed in claim 5, wherein each of the pixels further comprises:

a first capacitor coupled between the gate electrode of the first transistor and one of the data lines;

a third transistor coupled between the first capacitor and the one of the data lines and configured to be turned on when the first scan signal and the second scan signal are supplied to the scan lines;

a second capacitor coupled between the gate electrode of the first transistor and the first power source; and a fifth transistor coupled between the second electrode of the first transistor and the organic light emitting diode and configured to be turned off when the light emission control signal is supplied to the light emission control line and to be turned on otherwise.

8. The organic light emitting display device as claimed in claim 3, wherein the data driver is configured to supply a voltage of a reference power source to the data lines during the reset period, the compensation period, and the light emission period.

9. The organic light emitting display device as claimed in claim 8, wherein the voltage of the reference power source is a voltage within a voltage range of the data signals.

10. The organic light emitting display device as claimed in claim 3, further comprising:

switching elements coupled between the data lines and a reference power source and configured to be turned on during the reset period, the compensation period, and the light emission period.

11. The organic light emitting display device as claimed in claim 10, wherein a voltage of the reference power source is a voltage within a voltage range of the data signals.

12. The organic light emitting display device as claimed in claim 1, wherein the initial voltage is set to be a voltage lower than that of the first power source.

13. The organic light emitting display device as claimed in claim 12, wherein the fourth transistor is configured to supply a voltage applied to an anode electrode of the organic light emitting diode as the initial voltage.

14. The organic light emitting display device as claimed in claim 12, wherein the fourth transistor is configured to supply a voltage of the second power source as the initial voltage.

15. The organic light emitting display device as claimed in claim 12, wherein the fourth transistor is electrically coupled to an initial power source for supplying the initial voltage.

* * * * *